US006534465B1

(12) United States Patent
Briatore et al.

(10) Patent No.: US 6,534,465 B1
(45) Date of Patent: Mar. 18, 2003

(54) BLEACHING COMPOSITIONS

(75) Inventors: Andrea Briatore, Rome (IT); Giovanni Grande, Rome (IT); Oreste Todini, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/787,246

(22) PCT Filed: Sep. 16, 1999

(86) PCT No.: PCT/US99/21345

§ 371 (c)(1),
(2), (4) Date: Mar. 16, 2001

(87) PCT Pub. No.: WO00/15742

PCT Pub. Date: Mar. 23, 2000

(30) Foreign Application Priority Data

Sep. 16, 1998 (EP) ..... 98870193

(51) Int. Cl.[7] ..... C11D 3/395
(52) U.S. Cl. ..... 510/380; 510/379; 510/302
(58) Field of Search ..... 510/367, 379, 510/380, 381

(56) References Cited

U.S. PATENT DOCUMENTS

| | | | |
|---|---|---|---|
| 3,860,525 | A | 1/1975 | Bechtold |
| 4,083,795 | A | 4/1978 | Joubert |
| 4,789,495 | A | 12/1988 | Cahall et al. |
| 4,909,956 | A | 3/1990 | Webber |

FOREIGN PATENT DOCUMENTS

| | | |
|---|---|---|
| EP | 635 568 A1 | 1/1995 |
| EP | 825 250 A1 | 2/1998 |
| JP | 10072596 | 3/1998 |
| WO | WO99/32596 | 7/1999 |

*Primary Examiner*—Yogendra N. Gupta
*Assistant Examiner*—John M. Petruncio
(74) *Attorney, Agent, or Firm*—James F. McBride; Jason J. Camp; Kim W. Zerby

(57) ABSTRACT

The present invention relates to bleaching compositions comprising a hypohalite bleach, a borate or boric acid or mixture thereof, and a tertiary alcohol and/or a polyalcohol. These bleaching compositions exhibit excellent fabric yellowing-prevention performance and/or fabric safety.

20 Claims, No Drawings

BLEACHING COMPOSITIONS

CROSS REFERENCE TO RELATED APPLICATIONS

This application claims the benefit of PCT International Application Ser. No. PCT/US99/21345, filed Sep. 16, 1999, which in turn claims priority to EP 98870193.4 filed on Sep. 16, 1998.

FIELD OF THE INVENTION

The present invention relates to bleaching compositions, which can be used to bleach various surfaces including but not limited to fabrics, clothes, carpets and the like as well as hard-surfaces like walls, tiles, floors, glass, bathrooms surfaces, kitchen surfaces, toilet bowls and dishes.

BACKGROUND OF THE INVENTION

Bleach-containing compositions for bleaching various surfaces, e.g., fabrics, are well known in the art.

Amongst the different bleaching compositions available, those relying on bleaching by hypohalite bleach, such as hypochlorite, are often preferred, mainly for bleaching performance reasons.

However, a drawback associated with the use of hypohalite bleach-containing compositions, e.g., hypochlorite-based compositions, is that said compositions may potentially damage and/or cause yellowing of the fabrics being bleached. During the bleaching operation, a liquid hypochlorite-containing composition for example, can be applied onto the fabric in neat or diluted form. The hypochlorite bleach can be present in various forms, including hypochlorous acid and in the form of various molecule fragments resulting from its decomposition pathways. Hypochlorous acid and these molecule fragments are reactive with fabrics and may cause damage and/or yellowing of fabrics being bleached.

Therefore, bleaching compositions are often formulated comprising bleach and a fabric protective system. Compositions comprising bleach and one of various fabric protective systems are well known in the art. An example is a bleaching composition based on hypohalite bleach comprising a polymer and a borate as a fabric protective system (EP-A-0 824 147), or bleaching compositions based on hypochlorite comprising a metaborate as a fabric protective system (EP-A-0 781 840).

However, there are some limitations to the convenience of said bleaches comprising a fabric protective system. In particular, it is well known from consumer research that said compositions may still damage and/or yellow the fabrics which are being bleached, although said compositions comprise a fabric protective system.

It is therefore an object of the present invention to provide a bleach-containing composition, suitable for use in laundry applications, whereby the fabric yellowing-prevention is further improved.

It is a further object of the present invention to provide a bleaching composition, suitable for use in laundry application, whereby fabric safety is further improved.

Fabrics made of cotton and/or synthetic materials have free hydroxyl groups. It is believed that fabric damage and/or fabric yellowing occurs due to the oxidation of the hydroxyl groups by the bleach. The oxidation of the hydroxyl groups is believed to be further emphasised at lower pHs. Indeed, low pH shifts the chemical equilibrium between hypochlorite and hypochlorous acid in favor of the latter. Hypochlorous acid is a more aggressive bleach, which has been found to further contribute to fabric yellowing and fabric damage. Moreover, it is further believed that the hydroxyl groups of the fabric are more easily oxidised at lower pHs.

It has been found that fabric protection can be achieved using a combination of a borate and/or boric acid and a tertiary alcohol and/or a polyalcohol in bleach-containing compositions. The bleaching compositions of the present invention provide further improved fabric yellowing-prevention and/or further improved fabric safety on fabrics bleached therewith, as compared to bleaching compositions comprising other fabric protective systems, e.g., a metaborate alone, or bleaching compositions comprising no fabric protective system. It is believed that the hydroxyl groups of a fabric are protected by the fabric protective system as disclosed herein from oxidation by a bleach, especially a hypochlorite bleach, thus, providing fabric safety and/or fabric yellowing-prevention.

Advantageously the bleaching compositions of the present invention are suitable for various laundry bleaching applications both when used in diluted conditions, e.g., as a detergent additive or a fully formulated laundry detergent composition, and when used in neat condition, e.g., as a liquid pretreater (spotter).

A further advantage of the bleaching compositions according to the present invention is that they are able to perform in a variety of conditions, i.e., in hard and soft water as well as when used neat or diluted.

Yet another advantage of the bleaching compositions of the present invention is that said bleaching compositions may also be suitable for the bleaching of different types of surfaces including hard-surfaces like floors, walls, tiles, glass, kitchen surfaces, bathrooms surfaces, toilet bowls and/or dishes and the like, as well as fabrics. More particularly, the bleaching compositions of the present invention are suitable for bleaching any type of fabrics including natural fabrics (e.g., fabrics made of cotton, viscose, linen, silk and wool), synthetic fabrics such as those made of polymeric fibers of synthetic origin as well as those made of both natural and synthetic fibers. Indeed, the bleaching compositions of the present invention may be used on synthetic fibers despite a standing prejudice against the use of hypohalite bleaches, especially hypochlorite bleaches, on synthetic fibers, as evidenced by warning on labels of commercially available hypochlorite bleaches and clothes.

BACKGROUND ART

Bleach-containing compositions based on hypohalite bleach suitable for bleaching surfaces, e.g., fabrics or hard-surfaces, have been described in the art.

EP-A-781 840 discloses a composition comprising hypochlorite and a metaborate as a pH buffering means. However, compositions comprising a borate and/or boric acid and a tertiary alcohol as described herein are not disclosed.

EP-A-0 824 147 discloses liquid bleaching compositions comprising a hypohalite bleach and a polymer. The composition may further comprise a boron salt as pH buffering component. However, compositions comprising a borate and/or boric acid and a tertiary alcohol as described herein are not disclosed.

SUMMARY OF THE INVENTION

The present invention encompasses a bleaching composition comprising a hypohalite bleach, a borate or boric acid or a mixture thereof, and a tertiary alcohol or a polyalcohol or a mixture thereof.

The present invention also encompasses a process of bleaching surfaces, e.g., fabrics, wherein said surfaces are contacted with a bleaching composition as defined herein.

The present invention further encompasses the use of a borate or boric acid or a mixture thereof and a tertiary alcohol or a polyalcohol or a mixture thereof, as a fabric protective system in a hypohalite bleach-containing composition to treat fabrics whereby a fabric yellowing-prevention benefit and/or good fabric safety benefit is provided.

DETAILED DESCRIPTION OF THE INVENTION

The Bleaching Composition

The bleaching compositions may be formulated either as solids or liquids.

In the case where the bleaching compositions are formulated as solids, for example as granules, tablets or powders, they are preferably applied on the fabrics to be bleached according to the present invention in a liquid form, i.e., solid compositions are used in combination with an appropriate solvent, typically water.

In the case where the bleaching compositions are formulated as liquids including gel and paste form, the bleaching compositions are preferably but not necessarily formulated as aqueous compositions. Liquid bleaching compositions are preferred herein for convenience of use. Preferred liquid bleaching compositions of the present invention are aqueous and therefore, preferably comprise water in an amount of from 60% to 98%, more preferably of from 80% to 97% and most preferably 85% to 97% by weight of the total composition.

Hypohalite Bleach

As a first essential ingredient, the compositions of the present invention comprise a hypohalite bleach. Any hypohalite bleach known to those skilled in the art may be suitable for use herein.

Suitable hypohalite bleaches may be provided by a variety of sources, including bleaches that lead to the formation of positive halide ions and/or hypohalite ions, as well as bleaches that are organic based sources of halides, such as chloroisocyanurates.

Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chloroamines and chlorohydantoins.

For the bleaching compositions herein, the preferred hypohalite bleaches among those described above are the alkali metal or alkaline earth metal hypochlorites selected from the group consisting of sodium, potassium, magnesium, lithium and calcium hypochlorites, and mixtures thereof. Sodium hypochlorite is the most preferred hypohalite bleach.

Accordingly, the bleaching compositions according to the present invention may typically comprise from 0.01% to 20%, preferably from 0.25% to 15%, more preferably from 0.1% to 10%, even more preferably 0.5% to 8% and most preferably from 1% to 6% by weight of the total composition of a hypohalite bleach.

Borate or Boric Acid

As a second essential ingredient, the bleaching compositions according to the present invention comprise a borate or boric acid or a mixture thereof.

Suitable borates include alkali metal salts of borates and mixtures thereof. Suitable alkali metal salts of borates include alkali metal salts of metaborate, tetraborate, octoborate, pentaborate, dodecaborate, borontrifluoride and alkyl borates containing from 1 to 12, preferably from 1 to 4 carbon atoms. Preferred alkyl borate includes methyl borate, ethyl borate and propyl borate.

Particularly preferred herein are the alkali metal salts of metaborate, such as sodium metaborate, potassium metaborate, or mixtures thereof.

Borates like sodium metaborate and sodium tetraborate are commercially available from Borax and Societa Chimica Larderello under the name sodium metaborate and Borax®.

The borates provide a prolonged through-the-bleach buffering action, i.e., maintain the pH of the bleaching solution at a pH of at least 8, preferably at least 8.5, more preferably at least 9.5 for a longer period of time, throughout the bleaching process, e.g., at a dilution level of 200:1 (water:composition), as compared to the buffering action obtained with the same composition without said borate.

It has been found that the buffering action of the borate also affects the hypochlorite/hypochlorous acid such that the shift of hypochlorite into hypochlorous acid is reduced. It is believed that by controlling this equilibrium, fabric damage and/or fabric yellowing can be reduced.

The bleaching compositions according to the present invention may comprise from 0.01% to 10%, preferably from 0.1% to 10%, more preferably from 0.5% to 5%, even more preferably from 0.7% to 3%, and most preferably from 0.7% to 1.5% by weight of the total composition of said borate or boric acid or mixture thereof.

Tertiary Alcohol or Polyalcohol

As a third essential ingredient, the bleaching compositions according to the present invention comprise a tertiary alcohol or a polyalcohol or a mixture thereof.

Suitable tertiary alcohols or polyalcohols are according to the following formula:

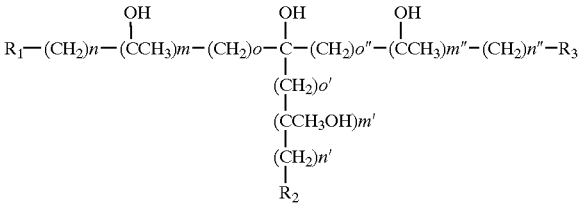

wherein: $R_1$, $R_2$ and $R_3$ are independently linear or branched, saturated or unsaturated hydrocarbon chains of from 1 to 30, preferably from 1 to 20, more preferably from 1 to 10, even more preferably from 1 to 7, carbon atoms optionally comprising one or more $C_5$ to $C_7$, preferably $C_6$, aromatic or aliphatic ring structures; and m, m', m" n, n', n", o, o' and o" are independently integers of from 0 to 1000, preferably 0 to 100, more preferably 0 to 50.

Examples of suitable tertiary alcohols include tert-butyl alcohol, tert-amyl alcohol, 2-methyl 2-butanol and 2-methyl 2-pentanol. A particularly preferred tertiary alcohol is 2-methyl 2-butanol.

An example of a suitable polyalcohol is 2,4-dimethyl butane-2,4-diol.

Suitable tertiary alcohols and polyalcohols are commercially available from Aldrich.

The bleaching composition according to the present invention may comprise from 0.001% to 20%, preferably from 0.001% to 5%, more preferably from 0.01% to 1%, and most preferably from 0.025% to 0.5% by weight of the total composition of a tertiary alcohol or a polyalcohol or mixture thereof as described herein.

In a preferred embodiment according to the present invention the molar ratio of borate or boric acid or a mixture thereof to tertiary alcohol or polyalcohol or a mixture thereof is from 1:1 to 30:1, more preferably from 1:1 to 25:1, more preferably from 2:1 to 25:1, and most preferably of 20:1.

Cotton fabrics contain cellulose (i.e., $(C_6H_{10}O_5)_n$). When a bleach-containing composition, e.g., a hypochlorite-containing composition, is used to bleach a cotton fabric, the bleach may react with the hydroxyl substituents of cellulose in position 6, 2, 3 and 5 of the cellulosic ring and thus may introduce new functional groups like carbonylic, aldehydic and/or carboxylic groups. Synthetic fabrics may be made of various synthetic materials like polyamide-elasthane that also comprises hydroxyl groups capable of being oxidized by bleach. The applicant believes that it is these new functional groups that cause fabric damage and/or yellowing.

It has now been found that a combination of a borate and/or boric acid and a tertiary alcohol and/or a polyalcohol as described herein, in the bleaching compositions according to the present invention act together as a fabric protective system. Compared to a bleach-containing composition comprising a fabric protective system other than that described by the present invention or no fabric protective system at all, the fabric yellowing-prevention performance and/or the fabric safety performance is further improved.

Whilst not wishing to be bound by theory, it is believed that the fabric protective system consisting of a borate and/or boric acid and of a tertiary alcohol and/or a polyalcohol as described herein, in a bleaching composition according to the present invention is capable of protecting, e.g., esterifying and/or complexing the hydroxyl groups present on the fibers of a treated fabric.

The fabric yellowing-prevention and/or fabric safety benefit can be achieved when using the compositions of the present invention neat, e.g., as a pretreater, as well as diluted, e.g., typical dilution with water in conventional washing conditions.

Indeed, the yellowing-prevention effect and/or safety effect of the present invention can be evaluated by comparing the composition according to the present invention to a bleach-containing composition comprising a fabric protective system other than that claimed by the present invention.

By "further improved fabric yellowing-prevention", it is meant herein that the yellowing of fabrics, i.e., the appearance of a yellowish tone of said fabrics, that occurs by using the hypohalite bleach-containing compositions of the present invention (e.g., those containing a hypochlorite bleach) is reduced ("fabric yellowing-prevention benefit"), compared to the yellowing that occurs by using a hypohalite bleach-containing composition comprising a fabric protective system other than that described by the present invention.

The degree of yellowing can be determined by both visual and instrumental grading. Visually, the difference in yellowing between items treated with different compositions can be determined by a team of expert panelists. Instrumentally, the assessment can be determined with the help of Colorimeters such as Ganz Griesser® instruments (e.g., Datacolor® Spectraflash® SF 500, Machbet White-eye® 500) or a ZEISS ELREPHO® or others which are available for instance from Hunterlab® or Gardner®.

By "further improved fabric safety", it is meant herein that the damage caused on fabric by using the hypohalite bleach-containing compositions of the present invention (e.g., those containing a hypochlorite bleach) is reduced ("fabric safety benefit"), compared to the damage caused by using a bleach-containing composition comprising a fabric protective system other than that described by the present invention.

Fabric safety may be evaluated by different test methods including the degree of polymerisation test method according to UNI (Ente Nazionale Italiano di Unificazione) official method UNI 8282-Determinazione della viscositá intrinseca in soluzione di cuprietilendiammina (CED).

Another aspect of the present invention is the use of a combination of a borate and/or boric acid and a tertiary alcohol and/or a polyalcohol, in a fabric bleaching composition comprising a hypohalite bleach to provide a fabric yellowing-prevention benefit and/or a fabric safety benefit of the bleaching composition.

pH

The preferred pH range of the bleaching composition is from 8 to 14, preferably from 8.5 to 14, more preferably from 9 to 13.5, and even more preferably from 9.5 to 13.5. It is in this alkaline pH range that the optimum stability and performance of the hypohalite bleach, e.g., hypochlorite, is obtained.

The compositions of the present invention may comprise an alkalinity source to adjust the pH of the compositions according to the present invention.

Preferred bleaching compositions herein may comprise up to 10%, preferably of from 0.04% to 5% and more preferably of from 0.1% to 2% by weight of the total composition of said alkalinity source.

Suitable alkalinity sources for use herein are the caustic alkalis, such as sodium hydroxide, potassium hydroxide and/or lithium hydroxide, and/or the alkali metal oxides such, as sodium and/or potassium oxide or mixtures thereof. A preferred alkalinity source is a caustic alkali, more preferably sodium hydroxide and/or potassium hydroxide.

Other suitable alkalinity sources include ammonia, ammonium carbonate and hydrogen carbonate.

Opitional pH Buffering Components

The bleaching compositions according to the present invention may optionally comprise a further pH buffering component, in addition to the pH buffering action that the borate may have. Particularly useful are alkali metal salts of carbonates, polycarbonates, sesquicarbonates, silicates, polysilicates, phosphonates, stannates, alluminates or mixtures thereof. The preferred alkali metal salts to be used herein are sodium and potassium salts. Particularly preferred are alkali metal salts of carbonate. The preferred alkali metal salt of carbonate is sodium carbonate.

The bleaching compositions of the present invention may comprise up to 10%, preferably from 0.01% to 5% and more preferably from 0.02% to 3% by weight of the total composition of a pH buffering component.

Other Optional Ingredients

The bleaching compositions according to the present invention may further comprise other optional ingredients, such as surfactants, polymers, pigments, dyes, optical brighteners, solvents, stabilizing agents, enzymes, chelating agents, radical scavengers, hydrotropes, perfumes and the like.

Stabilizing Agents

The bleaching compositions according to the present invention may further comprise a stabilizing agent, preferably a radical scavenger, a chelating agent or a mixture thereof. Naturally, for the purpose of the invention, the stabilizing agents have to be stable to the bleach used.

Highly preferred stabilizing agents are radical scavengers alone or in combination with a chelating agent.

Suitable radical scavengers for use herein include aromatic radical scavengers comprising an unsaturated ring system of from 3 to 20, preferably of from 3 to 18 and more preferably of from 5 to 14 carbon atoms and having a double bond set comprising a total of 4n+2 electrons, wherein n is an integer of from 0 to 4, preferably of from 1 to 3. Indeed said aromatic radical scavengers include benzene derivatives, naphthalene derivatives, annulene derivatives, cyclopentadiene derivatives, cyclopropene derivatives and the like, especially aryl carboxylates and/or aryl sulfonates.

Particularly suitable radical scavengers (aryl carboxylates, aryl sulphonate and derivatives thereof) for use in the present invention have one of the following formulae:

(a)

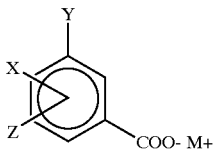

(b)

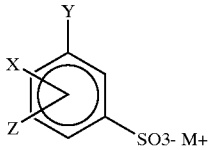

c)

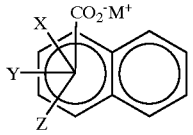

d)

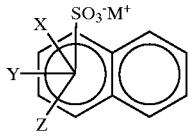

wherein each X, Y, and Z are —H, —$COO^-M^+$, —Cl, —Br, —$SO_3^-M^+$, —$NO_2$, —$OCH_3$, or a $C_1$ to $C_{10}$ primary and secondary alkyl groups and M is H or an alkali metal, or mixtures thereof. Examples of these components include pyromellitic acid, i.e., where X, Y and Z are —$COO^-H^+$; hemimellitic acid, trimellitic acid, i.e., where X and Y are —COO—$H^+$ and Z is H. Preferred to be used in the present invention as radical scavengers are phthalic acid; sulfophthalic acid; other mono-substituted phthalic acids; di-substituted benzoic acids; alkyl-, chloro-, bromo-, sulfo-, nitro- and alkoxy-benzoic acids, i.e., where Y and Z are —H and X is a $C_1$ to $C_{10}$ primary and secondary alkyl groups, —Cl, —Br, —$SO_3^-H^+$, —$NO_2$ or —$OCH_3$ (anisic acid) respectively and substituted sulfonic acids. Highly preferred examples of the radical scavengers useful in the present invention are benzoic acid, toluic acid, 4-toluene sulfonic acid, 3-nitro benzoic acid, 2 n-octyl benzoic acid, 2 n-octyl sulfonic acid, anisic acid or mixtures thereof. Most preferred herein are n-anisic acid, benzoic acid, methoxy benzoic acid and/or 3-nitrobenzoic acid.

The radical scavengers described above are the acidic forms of these species, i.e., M is H. It is intended that the present invention also covers the salt derivatives of these species, i.e., M is an alkali metal, preferably sodium or potassium. In fact, where the pH of the bleaching compositions of the present invention is in the alkaline range, the radical scavengers of the present invention exist primarily as the ionized salt in the aqueous composition herein. The anhydrous derivatives of certain species described herein above can also be used in the present invention, e.g., pyromellitic dianhydride, phthalic anhydride, sulphthalic anhydride and the like.

Suitable chelating agents for use herein may be any of those known to those skilled in the art such as the ones selected from the group comprising phosphonate chelating agents, phosphate chelating agents, polyfunctionally-substituted aromatic chelating agents, ethylenediamine N,N'-disuccinic acids, or mixtures thereof.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Suitable phosphate chelating agents are as follows: Phosphonic acid can be condensed in the reaction

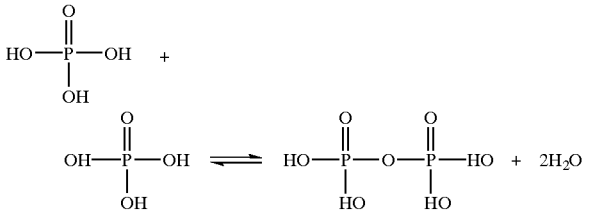

The reaction can be repeated with any of the reactive OH groups, and phosphate ingredients are obtained which can be linear or branched polyphosphates of structure

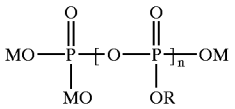

when R is M or

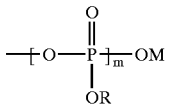

when M is a counterion, preferably alkali metal;

when $0 \leqq n+m<500$ (if n+m=0 then the compound is phosphonic acid)

cyclic polyphosphates (also referred to as metaphosphates), of structure

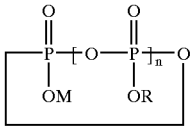

when R is M or

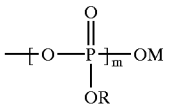

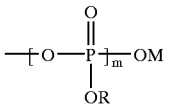

the phosphate compound contains both cycles and branched chain, and can be referred to as an ultraphosphate.)

where M is a counterion, preferably an alkali metal where $0 \leqq n+m<500$

All such phosphate ingredients are suitable for use herein, and preferred are linear phosphate ingredients (i.e., R is M) where n is 1 (pyrophosphate) and n is 2 (tripolyphosphate (STPP)), most preferably where n is 2. The most commonly available form of this phosphate is where M is Sodium.

Phytic acid, which is a chelating agent particularly suitable for use herein, is a hexa-phosphoric acid that occurs naturally in the seeds of many cereal grains, generally in the form of the insoluble calcium-magnesium salt. It may also be derived from corn steep liquor. Commercial grade phytic acid is commercially available from J.T. Baker Co., e.g., as a 40% aqueous solution. It is intended that the. present invention covers the acidic form of phytic acid as well as alkali metal salt derivatives thereof, particularly sodium or potassium salts thereof. Sodium phytate is available from Jonas Chemical Co (Brooklyn, N.Y.). In fact since the typical pH of the bleaching compositions of the present invention are in the alkaline pH range, the phytic acid component exists primarily as the ionized salt in the liquid compositions herein even if it is added in its acidic form. Mixtures of such salts of phytic acid are also covered.

Polyfunctionally-substituted aromatic chelating agents may also be useful in the bleaching compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acid is, for instance, commercially available under the tradename ssEDDS® from Palmer Research Laboratories.

Particularly preferred chelating agents for use herein are phosphate chelating agents like sodium tripolyphosphate, sodium pyrophosphate, phytic acid, and mixtures thereof.

Typically, the bleaching compositions according to the present invention may comprise from 0.01% to 10%, preferably from 0.01% to 8% by weight, more preferably from 0.1% to 5%, and most preferably from 0.2% to 3% by weight of the total composition of a stabilising agent.

Optional Surfactants

The bleaching compositions of the present invention may further comprise a surfactant. Said surfactant may be present in the bleaching compositions according to the present invention in amounts up to 30%, preferably of from 0.1% to 20% and more preferably of from 1% to 10% by weight of the total composition.

Surfactants for use herein include anionic surfactants, nonionic surfactants, cationic surfactants, amphoteric surfactants, zwitterionic surfactants, and mixtures thereof. Naturally, for the purpose of the invention, the surfactants have to be stable to the used bleach.

Particularly preferred nonionic surfactants are alkoxylated and non-alkoxylated nonionic surfactants. Suitable nonionic surfactants for use herein include capped and non-capped nonionic surfactants. Suitable non-capped alkoxylated and non-alkoxylated nonionic surfactants are according to the formula $RO—(C_2H_4O)_nH$, wherein R is a $C_6$ to $C_{22}$, preferably a $C_8$ to $C_{22}$ alkyl chain, or a $C_6$ to $C_{28}$ alkyl benzene chain, and wherein n is from 0 to 20, preferably from 1 to 15 and, more preferably from 2 to 15 and most preferably from 2 to 12. The preferred R chains for use herein are the $C_8$ to $C_{22}$ alkyl chains. Propoxylated, butoxylated, ethoxy/butoxylated, ethoxy/propoxylated, butoxy/propoxylated and ethoxy/butoxy/propoxylated nonionic surfactants may also be used herein.

Preferred non-capped nonionic surfactants are non-capped ethoxylated nonionic surfactants. Preferred non-capped ethoxylated nonionic surfactants are according to the formula above, wherein n is at least 1, and have an HLB (hydrophilic-lipophilic balance) below 16, preferably below 15, and more preferably below 14. Those ethoxylated nonionic surfactants have been found to provide good grease cutting properties.

Accordingly suitable non-capped ethoxylated nonionic surfactants for use herein are Dobanol® 91-2.5 (HLB=8.1; R is a mixture of $C_9$ and $C_{11}$ alkyl chains, n is 2.5), or Lutensol® TO3 (HLB=8; R is a $C_{13}$ alkyl chains, n is 3), or Lutensol® AO3 (HLB=8; R is a mixture of $C_{13}$ and $C_{15}$ alkyl chains, n is 3), or Tergitol® 25L3 (HLB=7.7; R is in the range of $C_{12}$ to $C_{15}$ alkyl chain length, n is 3), or Dobanol® 23-3 (HLB=8.1; R is a mixture of $C_{12}$ and $C_{13}$ alkyl chains, n is 3), or Dobanol® 23-2 (HLB=6.2; R is a mixture of $C_{12}$ and $C_{13}$ alkyl chains, n is 2), or Dobanol® 45-7 (HLB=11.6; R is a mixture of $C_{14}$ and $C_{15}$ alkyl chains, n is 7) Dobanol® 23-6.5 (HLB=11.9; R is a mixture of $C_{12}$ and $C_{13}$ alkyl chains, n is 6.5), or Dobanol® 25-7 (HLB=12; R is a mixture of $C_{12}$ and $C_{15}$ alkyl chains, n is 7), or Dobanol® 91-5 (HLB=11.6; R is a mixture of $C_9$ and $C_{11}$ alkyl chains, n is 5), or Dobanol® 91-6 (HLB=12.5; R is a mixture of $C_9$ and $C_{11}$ alkyl chains, n is 6), or Dobanol® 91-8 (HLB=13.7; R is a mixture of $C_9$ and $C_{11}$ alkyl chains, n is 8), Dobanol® 91-10 (HLB=14.2 ; R is a mixture of $C_9$ to $C_{11}$ alkyl chains, n is 10), Dobanol® 91-12 (HLB=14.5; R is a mixture of $C_9$ to $C_{11}$ alkyl chains, n is 12), or mixtures thereof. Preferred herein are Lutensol® TO3, or Lutensol® AO3, or Tergitol 25L3, or Dobanol® 23-3, or Dobanol® 23-6.5, or Dobanol® 45-7, Dobanol® 91-8, or Dobanol® 91-10, or Dobanol® 91-12, or mixtures thereof. These Dobanol® surfactants are commercially available from SHELL. These Lutensol® surfactants are commercially available from BASF and these Tergitol® surfactants are commercially available from UNION CARBIDE.

Suitable capped alkoxylated and non-alkoxylated nonionic surfactants, having the terminal hydroxyl group capped, are according to the formula: R(A)n-O—R1 where R and R1 are independently a $C_1$ to $C_{30}$, preferably a $C_1$ to $C_{20}$ alkyl chain, or a $C_1$ to $C_{18}$ alkyl benzene chain; A is an ethoxy or propoxy or butoxy unit; n is from 0 to 20, preferably from 1 to 15 and, more preferably from 2 to 15 and most preferably from 2 to 12. Capped ethoxy/butoxylated, ethoxy/propoxylated, butoxy/propoxylated and ethoxy/butoxy/propoxylated nonionic surfactants may also be used herein. A suitable capped alkoxylated nonionic surfactants for use herein is for instance Plurafac® LF231 commercially available from BASF.

Suitable chemical processes for preparing the alkoxylated nonionic surfactants for use herein include condensation of corresponding alcohols with alkylene oxide, in the desired proportions. Such processes are well known to the person skilled in the art and have been extensively described in the art.

In a preferred embodiment of the present invention the bleaching compositions herein may comprise one of those ethoxylated nonionic surfactants or a mixture of those ethoxylated nonionic surfactants having different HLBs (hydrophilic-lipophilic balance). In a preferred embodiment the bleaching compositions herein comprise an ethoxylated nonionic surfactant according to the above formula and having an HLB of up to 10 (i.e., a so called hydrophobic ethoxylated nonionic surfactant), preferably below 10, more preferably below 9, and an ethoxylated nonionic surfactant according to the above formula and having an HLB of above 10 to 16 (i.e., a so called hydrophilic ethoxylated nonionic surfactant), preferably from 11 to 14. Indeed, in this preferred embodiment the bleaching compositions of the present invention typically comprise from 0.01% to 15% by weight of the total composition of said hydrophobic ethoxylated nonionic surfactant, preferably from 0.5% to 10% and from 0.01% to 15% by weight of said hydrophilic ethoxylated nonionic surfactant, preferably from 0.5% to 10%. Such mixtures of ethoxylated nonionic surfactants with different HLBs may be desired as they allow optimum grease cleaning removal performance on a broader range of greasy soils having different hydrophobic/hydrophilic characters.

Other suitable nonionic surfactants to be used herein include polyhydroxy fatty acid amide surfactants, or mixtures thereof, according to the formula:

$$R^2—C(O)—N(R^1)—Z,$$

wherein $R^1$ is H, or $C_1$–$C_4$ alkyl, $C_1$–$C_4$ hydrocarbyl, 2-hydroxy ethyl, 2-hydroxy propyl or a mixture thereof, $R^2$ is $C_5$–$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_1$–$C_4$ alkyl, more preferably $C_1$ or $C_2$ alkyl and most preferably methyl, $R^2$ is a straight chain $C_7$–$C_{19}$ alkyl or alkenyl, preferably a straight chain $C_9$–$C_{18}$ alkyl or alkenyl, more preferably a straight chain $C_{11}$–$C_{18}$ alkyl or alkenyl, and most preferably a straight chain $C_{11}$–$C_{14}$ alkyl or alkenyl, or mixtures thereof. Z preferably will be derived from a reducing sugar in a reductive amination reaction; more preferably Z is a glycityl. Suitable reducing sugars include glucose, fructose, maltose, lactose, galactose, mannose and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2—(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2—(CHOH)_4—CH_2OH$.

In formula $R^2—C(O)—N(R^1)—Z$, $N(R^1)$ can be, for example, N-methyl, N-ethyl, N-propyl, N-isopropyl, N-butyl, N-2-hydroxy ethyl, or N-2-hydroxy propyl. $R^2—C(O)—N<$ can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygalactityl, 1-deoxymannityl, 1-deoxymaltotriotityl and the like.

Suitable polyhydroxy fatty acid amide surfactants to be used herein are commercially available under the trade name HOE® from Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934, to Piggott and WO92/06070, each of which is incorporated herein by reference.

Suitable anionic surfactants for use herein are all those commonly known by those skilled in the art. Preferably, the anionic surfactants for use herein include alkyl sulphonates, alkyl aryl sulphonates, alkyl sulphates, alkyl alkoxylated sulphates, $C_6$–$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is a $C_6$–$C_{20}$ linear or branched, saturated or unsaturated alkyl group, preferably a $C_8$–$C_{18}$ alkyl group and more preferably a $C_{10}$–$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$–$C_{20}$ linear or branched saturated or unsaturated alkyl group, preferably a $C_8$–$C_{18}$ alkyl group and more preferably a $C_{10}$–$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

By "secondary $C_6$–$C_{20}$ alkyl or $C_6$–$C_{20}$ alkyl aryl sulphonates", it is meant herein that in the formula as defined above, the $SO_3M$ or aryl-$SO_3M$ group is linked to a carbon atom of the alkyl chain being placed between two other carbons of the said alkyl chain (secondary carbon atom).

An example of a $C_{14}$–$C_{16}$ alkyl sulphonate is Hostapur® SAS available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

Suitable alkyl sulphate surfactants for use herein are according to the formula $R_1SO_4M$ wherein $R_1$ represents a hydrocarbon group selected from the group consisting of straight or branched alkyl radicals containing from 6 to 20 carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

By "linear alkyl sulphate or sulphonate" it is meant herein a non-substituted alkyl sulphate or sulphonate wherein the alkyl chain comprises from 6 to 20 carbon atoms, preferably from 8 to 18 carbon atoms, and more preferably from 10 to 16 carbon atoms, and wherein this alkyl chain is sulphated or sulphonated at one terminus.

By "branched sulphonate or sulphate", it is meant herein an alkyl chain having from 6 to 20 total carbon atoms, preferably from 8 to 18 total carbon atoms, and more preferably from 10 to 16 total carbon atoms, wherein the main alkyl chain is substituted by at least another alkyl chain, and wherein the alkyl chain is sulphated or sulphonated at one terminus.

Particularly preferred branched alkyl sulphates to be used herein are those containing from 10 to 14 total carbon atoms like Isalchem 123 AS®. Isalchem 123 AS® commercially available from Enichem is a $C_{12\text{-}13}$ surfactant which is 94% branched. This material can be described as $CH_3$—$(CH_2)_m$—$CH(CH_2OSO_3Na)$—$(CH_2)_n$—$CH_3$ where n+m=8–9. Also preferred alkyl sulphates are the alkyl sulphates where the alkyl chain comprises a total of 12 carbon atoms, i.e., sodium 2-butyl octyl sulphate. Such alkyl sulphate is commercially available from Condea under the trade name Isofol® 12S. Particularly suitable liner alkyl sulphonates include $C_{12}$–$C_{16}$ paraffin sulphonate like Hostapur® SAS commercially available from Hoechst.

Suitable alkyl alkoxylated sulphate surfactants for use herein are according to the formula $RO(A)_mSO_3M$ wherein R is an unsubstituted $C_6$–$C_{20}$ alkyl or hydroxyalkyl group having a $C_6$–$C_{20}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E(1.0)SM), $C_{12}$–$C_{18}$ alkyl polyethoxylate (2.25) sulfate ($C_{12}$–$C_{18}$E(2.25)SM), $C_{12}$–$C_{18}$ alkyl polyethoxylate (3.0) sulfate ($C_{12}$–$C_{18}$E(3.0)SM), and $C_{12}$–$C_{18}$ alkyl polyethoxylate (4.0) sulfate ($C_{12}$–$C_{18}$E(4.0)SM), wherein M is conveniently selected from sodium and potassium.

Suitable $C_6$–$C_{20}$ alkyl alkoxylated linear or branched diphenyl oxide disulphonate surfactants for use herein are according to the following formula:

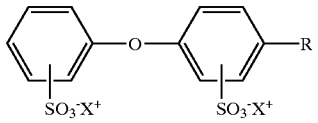

wherein R is a $C_6$–$C_{20}$ linear or branched, saturated or unsaturated alkyl group, preferably a $C_{12}$–$C_{18}$ alkyl group and more preferably a $C_{14}$–$C_{16}$ alkyl group, and X+ is H or a cation, e.g., an alkali metal cation (e.g., sodium, potassium, lithium, calcium, magnesium and the like). Particularly suitable $C_6$–$C_{20}$ alkyl alkoxylated linear or branched diphenyl oxide disulphonate surfactants to be used herein are the $C_{12}$ branched di phenyl oxide disulphonic acid and $C_{16}$ linear di phenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$–$C_{24}$ olefinsulfonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as C14-16 methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO$—$M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23.

Suitable amphoteric surfactants to be used herein include amine oxides having the following formula $R_1R_2R_3NO$ wherein each of $R_1$, $R_2$ and $R_3$ is independently a saturated substituted or unsubstituted, linear or branched hydrocarbon chains of from 1 to 30 carbon atoms. Preferred amine oxide surfactants to be used according to the present invention are amine oxides having the following formula: $R_1R_2R_3NO$ wherein $R_1$ is an hydrocarbon chain comprising from 1 to 30 carbon atoms, preferably from 6 to 20, more preferably from 8 to 16, most preferably from 8 to 12; and wherein $R_2$ and $R_3$ are independently substituted or unsubstituted, linear or branched hydrocarbon chains comprising from 1 to 4 carbon atoms, preferably from 1 to 3 carbon atoms, and more preferably are methyl groups. $R_1$ may be a saturated substituted or unsubstituted linear or branched hydrocarbon chain. Suitable amine oxides for use herein are for instance natural blend $C_8$–$C_{10}$ amine oxides as well as $C_{12}$–$C_{16}$ amine oxides commercially available from Hoechst.

Suitable zwitterionic surfactants for use herein contain both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used.

A generic formula for preferred zwitterionic surfactants for use herein (i.e., betaine and/or sulfobetaine) is:

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is a carboxylate or sulfonate group, preferably sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula: $R_a—C(O)—NR_b—(C(R_c)_2)_m$, wherein $R_a$ is an aliphatic or aromatic, saturated or unsaturated, substituted or unsubstituted hydrocarbon chain containing from 8 up to 20 carbon atoms, preferably an alkyl group containing from 8 up to 20 carbon atoms, preferably up to 18, more preferably up to 16; $R_b$ is either a hydrogen a short chain alkyl or substituted alkyl containing from 1 to 4 carbon atoms, preferably a group selected from the group consisting of methyl, ethyl, propyl, hydroxy substituted ethyl or propyl and mixtures thereof, more preferably methyl or hydrogen; $R_c$ is selected from the group consisting of hydrogen and hydroxy groups, and m is from 1 to 4, preferably from 2 to 3, more preferably 3, with no more than one hydroxy group in any $(C(R_c)_2)$ moiety.

Preferred $R_2$ is hydrogen, or an alkyl or substituted alkyl containing from 1 to 4 carbon atoms, preferably a group selected from the group consisting of methyl, ethyl, propyl, hydroxy substituted ethyl or propyl and mixtures thereof, more preferably methyl. Preferred $R_3$ is a $C_1$–$C_4$ carboxylic acid group, a $C_1$–$C_4$ sulfonate group, or an alkyl or substituted alkyl containing from 1 to 4 carbon atoms, preferably a group selected from the group consisting of methyl, ethyl, propyl, hydroxy substituted ethyl or propyl and mixtures thereof, more preferably methyl. Preferred $R_4$ is $(CH_2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, N-dimethylammonia)acetate, 2-(N-coco N, N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

A further example of betaine is Lauryl-imminodipropionate commercially available from Rhone-Poulenc under the trade name Mirataine $H_2C$-HA®.

Particularly preferred zwitterionic surfactants for use in the bleaching compositions of the present invention are the sulfobetaine surfactants as they deliver optimum soap scum cleaning benefits.

Examples of particularly suitable sulfobetaine surfactants include tallow bis(hydroxyethyl) sulphobetaine, cocoamido propyl hydroxy sulfobetaines which are commercially available from Rhone Poulenc and Witco, under the trade name of Mirataine CBS® and Rewoteric AM CAS 15® respectively.

Further examples of amidobetaines/amidosulfobetaine include cocoamidoethylbetaine, cocoamidopropyl betaine or $C_{10}$–$C_{14}$ fatty acylamidopropylene(hydropropylene) sulfobetaine. For example $C_{10}$–$C_{14}$ fatty acylamidopropylene(hydropropylene)sulfobetaine is commercially available from Sherex Company under the trade name "Varion CAS® sulfobetaine".

Suitable amines for use herein are according to the following formula RR'R"N wherein R is a saturated or unsaturated, substituted or unsubstituted, linear or branched alkyl groups containing from 1 to 30 carbon atoms, and preferably from 1 to 20 carbon atoms and wherein R' and R" are independently saturated or unsaturated, substituted or unsubstituted, linear or branched alkyl groups containing from 1 to 30 carbon atoms or hydrogen. Particularly preferred amines to be used according to the present invention are amines having the following formula RR'R"N wherein R is a saturated or unsaturated, linear or branched alkyl group containing from 1 to 30 carbon atoms, preferably from 8 to 20 carbon atoms, more preferably from 6 to 16, most preferably from 8 to 14 and wherein R' and R" are independently substituted or unsubstituted, linear or branched alkyl groups containing from 1 to 4 carbon atoms, preferably from 1 to 3 carbon atoms, and more preferably are methyl groups, or mixtures thereof.

Suitable amines for use herein are for instance $C_{12}$ dimethyl amine, coconut dimethyl amine, $C_{12}$–$C_{16}$ dimethyl amine. Said amines may be commercially available from Hoechst under the trade name Genamin®, AKZO under the trade name Aromox® or Fina under the trade name Radiamine®.

Suitable quaternary ammonium surfactants for use herein are according to the formula: $R_1R_2R_3R_4N^+X^-$, wherein X is a counteranion such as halogen, methyl sulphate, methyl sulphonate, or hydroxide; $R_1$ is a saturated or unsaturated, substituted or unsubstituted, linear or branched alkyl group containing from 1 to 30 carbon atoms, preferably from 12 to 20, more preferably from 8 to 20; and $R_2$, $R_3$ and $R_4$ are independently hydrogen, or saturated or unsaturated, substituted or unsubstituted, linear or branched alkyl groups containing from 1 to 4 carbon atoms, preferably from 1 to 3 and more preferably methyl. In highly preferred quaternary ammonium surfactants herein $R_1$ is a $C_{10}$–$C_{18}$ hydrocarbon chain, most preferably $C_{12}$, $C_{14}$, or $C_{16}$; and $R_2$, $R_3$ and $R_4$ are all three methyl, and X is halogen, preferably bromide or chloride, most preferably bromide.

Examples of quaternary ammonium surfactants are myristyl trimethylammonium methyl sulphate, cetyl trimethylammonium methyl sulphate, lauryl trimethyl ammonium bromide, stearyl trimethyl ammonium bromide (STAB), cetyl trimethyl ammonium bromide (CTAB) and myristyl trimethyl ammonium bromide (MTAB). Highly preferred herein are lauryl trimethyl ammonium salts. Such trimethyl quaternary ammonium surfactants may be commercially available from Hoechst, or from Albright & Wilson under the trade name Empigen CM®.

Cationic surfactants suitable for use in bleaching compositions of the present invention are those having a long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than 1000, and hydrogen when y is not 0; $R^5$ is the same as $R^4$ or is an alkyl chain wherein the total number of carbon atoms of $R^2$ plus $R^5$ is not more than 18; each y is from 0 to 10 and the sum of the y values is from 0 to 15; and X is any compatible anion.

Other cationic surfactants useful herein are also described in U.S. Pat. No. 4,228,044, Cambre, issued Oct. 14, 1980, incorporated herein by reference.

Optional Polymers

An optional component of the bleaching compositions herein is a polymer. Naturally, for the purpose of the invention, the polymer has to be stable in the presence of the hypohalite bleach.

Suitable polymers for use are polymers comprising monomeric units selected from the group consisting of unsaturated carboxylic acids, polycarboxylic acids, sulphonic acids, phosphonic acids and mixtures thereof. Co-polymerisation of the above monomeric units among them or with other co-monomers such as styrenesulfonic acid is also suitable.

Preferred examples of such polymers are the polymers and co-polymers of monomeric units selected from the group consisting of acrylic acid, maleic acid, vinylsulphonic acid and mixtures thereof. Also suitable for use herein are the above mentioned polymers and co-polymers which are modified in order to contain other functional groups such as aminophosphonic and/or phosphonic units. More preferred polymers are selected from the group consisting of polyacrylate polymers, co-polymers of acrylic and maleic acid, co-polymers of styrene sulphonic acid and maleic acid, and mixtures thereof, preferably modified with aminophosphonic and/or phosphonic groups.

The molecular weight for these polymers and co-polymers is preferably below 100,000, most preferably between 500 and 50,000. In an embodiment of the present invention where the bleaching compositions herein comprise a hypochlorite bleach, the most suitable polymers and co-polymers for use herein will be soluble in an amount up to 0.1% by weight, in an aqueous bleaching composition comprising 5% by weight of sodium hypochlorite with its pH adjusted to 13 with sodium hydroxide.

Commercially available polymers, suitable for use herein, are the polyacrylate polymers sold under the tradename Good-Rite® from BF Goodrich, Acrysol® from Rohm & Haas, Sokalan® from BASF, Norasol® from Norso Haas. Also suitable for use herein are the co-polymers of styrene sulphonic acid and maleic acid, commercially available under the tradename Versaflex® from National Starch such as Versaflex 157, as well as Acumer® terpolymers from Rohm and Haas, in particular Acumer® 3100. Preferred commercially available polymers are the polyacrylate polymers, especially the Norasol® polyacrylate polymers and more preferred are the polyacrylate polymer Norasol® 410N (MW 10,000) and the polyacrylate polymer modified with phosphonic groups Norasol® 440N (MW 4000) and its corresponding acid form Norasol® QOR 784 (MW 4000).

A preferred polymer for use herein is a polyacrylate polymer modified with phosphonic groups commercially available under the tradename Norasol® 440N (MW 4000) and its corresponding acid form Norasol® QOR 784 (MW 4000) from Norso-Haas.

Mixtures of the polymers described herein may also be used in the present invention.

Polymers herein may be present in low amounts, i.e., in amounts of up to 10% by weight, preferably up to 1%, more preferably from 0.001% to 0.5% by weight, most preferably from 0.005% to 0.2% by weight of the total composition.

Optional Brighteners

The bleaching compositions according to the present invention may also comprise a brightener as an optional ingredient. Naturally, for the purpose of the invention, the brightener has to be stable in the presence of the bleach used. The brighteners may be desired herein to further enhance the whiteness performance of the bleaching compositions herein.

Brighteners are compounds which have the ability to fluoresce by absorbing ultraviolet wave-lengths of light and re-emitting visible light. Brighteners, also referred to as fluorescent whitening agent (FWA), have been extensively described in the art, see for instance EP-A-0 265 041, EP-A-0 322 564, EP-A-0 317 979 or "Fluorescent whitening agents" by A. K. Sarkar, published by MERROW, especially page 71–72.

Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982). Further optical brighteners which may also be used in the present invention include naphthlimide, benzoxazole, benzofuran, benzimidazole and any mixtures thereof.

Examples of optical brighteners which are useful in the present bleaching compositions are those identified in U.S. Pat. No. 4,790,856. These brighteners include the PHOR- WHITE® series of brighteners from Verona. Other brighteners disclosed in this reference include: Tinopal-UNPA®, Tinopal CBS® and Tinopal 5BM® available from Ciba-Geigy; Artic White CC® and Artic White CWD®; the 2-(4-styryl-phenyl)-2H-naptho[1,2-d]triazoles; 4,4'-bis(1,2,3-triazol-2-yl)-stilbenes; 4,4'-bis(styryl)bisphenyls; and the aminocoumarins.

Specific examples of brighteners useful herein include 4-methyl-7-diethyl-amino coumarin; 1,2-bis(-benzimidazol-2-yl)ethylene; 1,3-diphenyl-pyrazolines; 2,5-bis(benzoxazol-2-yl)thiophene; 2-styryl-naptho-[1,2-d]oxazole; 2-(stilbene-4-yl)-2H-naphtho[1,2-d]triazole, 3-phenyl-7-(isoindolinyl)coumarin; 3-methyl-7-(isoindolinyl)coumarin; 3-chloro-7-(isoindolinyl)coumarin; 4-(isoindolinyl)-4'-methylstilbene; 4-(isoindolinyl)-4'-methoxystilbene; sodium 4-(isoindolinyl)-4'-stilbenesulfonate; 4-(isoindolinyl)-4'-phenylstilbene; 4-(isoindolinyl)-3-methoxy-4'-methylstilbene; 4-(2-chloroisoindolinyl)-4'-(2-methylisoindolinyl)-2,2'-stilbenedisosulfonic acid; disodium 4,4'-diisoindolinyl-2,2'-stilbene disulfonate; 4,4'-diisoindolinyl-2,2'-stilbenedisulfonamide; disodium 4,4'-(7,8-dichloro-1-isoindolinyl)2,2-stilbenedisulfonate; disodium 4,4'-(7-chloro-1-isoindolinyl)2,2-stilbenedisulfonate; disodium 4,4'-(6-Isopropoxy-1-isoindolinyl)2,2-stilbenedisulfonate; disodium 4,4'-(7,8-diisopropyl-1-isoindolinyl)2,2-stilbenedisulfonate; disodium 4,4'-(7-butoxy-1-isoindolinyl)2,2-stilbenedisulfonate; disodium 4,4'-(6-trifluoromethyl-1-isoindolinyl)2,2-stilbenedisulfonate; disodium 4,4'-[6-(1,4,7-trioxanonyl)-1-isoindolinyl)]2,2-stilbenedisulfonate; disodium 4,4'-(7-methoxymethyl-1-isoindolinyl)2,2-stilbenedisulfonate; disodium 4,4'-(6-phenyl-1-isoindolinyl)2,2-stilbenedisulfonate; disodium 4,4'-(6-naphthyl-1-isoindolinyl)2,2-stilbenedisulfonate; disodium 4,4'-(6-methylsulfonyl-1-isoindolinyl)2,2-stilbenedisulfonate; disodium 4,4'-(7-cyano-1-isoindolinyl)2,2-stilbenedisulfonate; and disodium 4,4'-[7-(1,2,3-trihydroxypropyl)-1-isoindolinyl)]2,2-stilbenedisulfonate; disodium 4-isoindolinyl-4'-ethoxy-2,2'-stilbenedisulfonate; disodium 4-isoindolinyl-4'-methoxy-2,2'-stilbenedisulfonate; disodium 4-isoindolinyl-4'-ethoxy-2,2'-stilbenedisulfonamide; disodium 4-isoindolinyl-4'-methyl-2,2'-stilbenedisulfonamide; 4,4'-bis(4-phenyl-2H-1,2,3-triazol-2-yl)-2,2'-stilbenedisulfonic acid and mixture thereof. See also U.S. Pat. Nos. 3,646,015, 3,346,502 and 3,393,153 for further examples of brighteners useful herein.

Indeed one of the functionally equivalent derivative salts of 4,4'-bis(4-phenyl-2H-1,2,3-triazol-2-yl)-2,2'-stilbenedisulfonic acid, namely its sodium salt is available from Mobay Chemical Corporation, a subsidiary of Bayer AG under the name Phorwite® CAN. The amine salt is available from Molay under the name Phorwite® CL solution. The potassium salt is available under the name Phorwite® BHC 766.

Other specific examples of optical brighteners useful in the present invention are those having the structural formula:

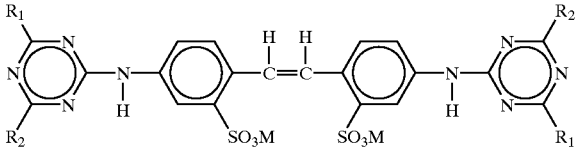

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Other substituted stilbene 2,2'-disulfonic acid derivatives also include 4-4'-bis(2-2'styryl sulfonate)biphenyl, commercially available from Ciba-Geigy under the trade name Brightener 49® or other hydrophilic brighteners like for example Brightener 3® or Brightener 47®, also commercially available from Ciba-Geigy.

Further specific examples of brighteners useful in the present invention include the polycyclic oxazole derivatives such as benzo-oxazole derivatives, or mixtures thereof and particularly preferred herein the benzo-oxazole derivatives. An example of such a brightener is benzoxazole,2,2'-(thiophenaldyl)bis having the following formula $C_{18}H_{10}N_2O_2S$, commercially available from Ciba-Geigy under the trade name Tinopal SOP®. This brightener is almost insoluble in water, i.e., it has a solubility being lower than 1 gram per liter. Another example of such a brightener is bis(sulfobenzofuranyl)biphenyl, commercially available from Ciba-Geigy under the trade name Tinopal PLC®.

Typically the bleaching compositions according to the present invention may comprise up to 1.0%, preferably from 0.005% to 0.5%, more preferably from 0.005% to 0.3% and most preferably from 0.008% to 0.1% by weight of the total composition of a brightener.

Process of Treating Surfaces

In the present invention, the bleaching composition of the present invention is used by applying the composition to the surface to be treated. The compositions according to the present invention are preferably used in liquid form.

By "in liquid form" it is meant that liquid compositions can be used per se in neat or in diluted form, and solid compositions, for example granules, tablets or powders, are dissolved in an appropriate solvent, typically water, before use, i.e., before being contacted to said surface.

By "in diluted form", it is meant herein that the compositions for the bleaching of fabrics according to the present invention may be diluted with a solvent by the user, the preferred solvent is water. Such dilution may occur for instance in hand laundry applications as well as by other means such as in a washing machine. Said compositions can be used at a dilution level of up to 500:1 (solvent:composition), preferably from 5:1 to 200:1 and more preferably from 10:1 to 80:1 (solvent:composition).

By "in its neat form", it is to be understood that the liquid compositions are applied directly onto the fabrics to be treated without undergoing any dilution, i.e., the liquid compositions herein are applied onto the fabrics as described herein.

By "surfaces", it is meant herein any inanimate surface. These inanimate surfaces include, but are not limited to, hard-surfaces typically found in houses like kitchens, bathrooms, or in car interiors, e.g., tiles, walls, floors, chrome, glass, smooth vinyl, any plastic, plastified wood, table top, sinks, cooker tops, dishes, sanitary fittings such as sinks, showers, shower curtains, wash basins, WCs and the like, as well as fabrics including clothes, curtains, drapes, bed linens, bath linens, table cloths, sleeping bags, tents, upholstered furniture and the like, and carpets. Inanimate surfaces also include household appliances including, but not limited to, refrigerators, freezers, washing machines, automatic dryers, ovens, microwave ovens, dishwashers and so on.

By "treating a surface", it is meant herein bleaching and/or disinfecting said surfaces as the compositions of the present invention comprise a bleach.

Thus, the present invention also encompasses a process of treating (e.g., bleaching) a fabric, as the inanimate surface. In such a process a composition according to the present invention is contacted with the fabrics to be treated.

This can be done either in a so-called "pretreatment mode", where a liquid bleaching composition, as defined herein, is applied neat onto said fabrics before the fabrics are rinsed, or washed then rinsed, or in a "soaking mode" where a bleaching composition, as defined herein, is first diluted in an aqueous bath and the fabrics are immersed and soaked in the bath, before they are rinsed, or in a "through the wash mode", where a bleaching composition, as defined herein, is added on top of a wash liquor formed by dissolution or dispersion of a typical laundry detergent. It is also essential in both cases, that the fabrics be rinsed after they have been contacted with said composition, before said composition has completely dried off.

The compositions according to the present invention are preferably used on fabrics in a liquid form. More specifically, the process of bleaching fabrics according to the present invention comprises the steps of first contacting said fabrics with a bleaching composition according to the present invention, in its diluted form, then allowing said fabrics to remain in contact with said composition, for a period of time sufficient to bleach said fabrics, typically 1 to 60 minutes, preferably 5 to 30 minutes, then rinsing said fabrics with water. If said fabrics are to be washed, i.e., with a conventional composition comprising at least one surface active agent, said washing may be conducted by contacting said fabrics at the same time with a bleaching composition according to the present invention and said detergent composition, or said washing may be conducted before or after said fabrics have been bleached. Accordingly, said process allows the bleaching of fabrics and optionally the washing of fabrics with a detergent composition comprising at least one surface active agent before the step of contacting said fabrics with said bleaching composition and/or in the step where said fabrics are contacted with said bleaching composition and/or after the step where said fabrics are contacted with the bleaching composition and before the rinsing step and/or after the rinsing step.

In another embodiment of the present invention the process of bleaching fabrics comprises the step of contacting fabrics with a liquid bleaching composition according to the present invention, in its neat form, of allowing said fabrics to remain in contact with said bleaching composition for a period of time sufficient to bleach said fabrics, typically 5 seconds to 30 minutes, preferably 1 minute to 10 minutes and then rinsing said fabrics with water. If said fabrics are to be washed, i.e., with a conventional composition comprising at least one surface active agent, said washing may be conducted before or after that said fabrics have been bleached. In an embodiment of the present invention wherein the liquid bleaching composition of the present invention, is contacted to the fabrics in its neat form, it is preferred that the level of hypohalite bleach, is from 0.01% to 5%, preferably from 0.1% to 3.5%, more preferably from 0.2% to 2% and most preferably from 0.2% to 1%. Advantageously, the present invention provides liquid hypohalite bleach-containing compositions that may be applied neat onto a fabric to bleach, despite a standing prejudice against using hypochlorite-containing compositions neat on fabrics.

It is preferred to perform the bleaching process herein before said fabrics are washed. Indeed, it has been observed that bleaching said fabrics with the compositions according to the present invention (diluted and/or neat bleaching processes) prior to washing them with a detergent composition provides superior whiteness and stain removal with less energy and detergent than if said fabrics are washed first, then bleached.

Alternatively instead of following the neat bleaching process as described above (pretreatment application) with a rinsing step and/or a conventional washing step with a liquid or powder conventional detergent, the bleaching pretreatment operation may also be followed by the diluted bleaching process as described above either in bucket (hand operation) or in a washing machine.

In another embodiment the present invention also encompasses a process of treating a hard-surface, as the inanimate surface. In such a process a composition, as defined herein, is contacted with the hard-surfaces to be treated. The process of treating a hard-surface with a composition, as defined herein, comprises the step of applying said composition to said hard-surface, and optionally rinsing said hard-surface.

In the process of treating hard-surfaces according to the present invention the composition, as defined herein, may be applied to the surface to be treated in its neat form or may be applied at a dilution level of up to 200:1 (solvent:composition), preferably from 2:1 to 80:1 and more preferably from 2:1 to 60:1 (solvent:composition), preferably using water as the solvent.

When used as hard-surfaces bleaching/disinfecting compositions the compositions of the present invention are easy to rinse and provide good shine characteristics on the treated surfaces.

EXAMPLES

The following compositions which further illustrate the present invention were made by mixing the listed ingredients in the listed proportions:

| Compositions (weight %) | I | II | III | IV | V | VI | VII |
|---|---|---|---|---|---|---|---|
| Sodium hypochlorite | 5.0 | 5.0 | 5.0 | 2.5 | 2.5 | 5.0 | 5.0 |
| Sodium hydroxide | 1.3 | 1.3 | 1.3 | 0.7 | 1.4 | 0.7 | 1.4 |
| Sodium carbonate | 1.2 | 1.2 | 1.2 | 1.0 | 1.2 | 1.2 | 1.2 |
| Sodium silicate | — | — | — | — | — | 0.2 | — |
| Sodium metaborate | 1.0 | — | 0.75 | 1.0 | 0.75 | 0.5 | — |
| Sodium tetraborate | — | 0.5 | 1.0 | — | — | — | 0.25 |

-continued

| | | | | | | | |
|---|---|---|---|---|---|---|---|
| Tert-butyl alcohol | 0.1 | 0.2 | 0.3 | 0.4 | 0.5 | 1.0 | 0.1 |
| 2-methyl 2-butanol | — | — | — | — | — | — | 0.1 |
| Minors and water | | | balance up to 100% | | | | |

| Compositions (weight %) | VIII | IX | X | XI | XII | XIII | XIV |
|---|---|---|---|---|---|---|---|
| Sodium hypochlorite | 5.0 | 5.0 | 5.0 | 2.5 | 2.5 | 5.0 | 5.0 |
| Sodium hydroxide | 1.3 | 1.3 | 1.3 | 0.7 | 1.4 | 0.7 | 1.4 |
| Sodium carbonate | 1.2 | 1.2 | 1.2 | 1.0 | 1.2 | 1.2 | 1.2 |
| Sodium silicate | — | — | — | — | — | 0.2 | — |
| Sodium metaborate | 1.0 | — | 0.75 | 1.0 | 0.75 | 0.5 | — |
| Sodium tetraborate | — | 0.5 | 1.0 | — | — | — | 0.25 |
| 2,4-dimethyl-butane-2,4-diol | 0.1 | 0.5 | 0.1 | 1.0 | 0.25 | 1.2 | 0.5 |
| Minors and water | | | balance up to 100% | | | | |

| Compositions (weight %) | XV | XVI | XVII | XVIII | XIX | XX | XXI |
|---|---|---|---|---|---|---|---|
| Sodium hypochlorite | 5.0 | 5.0 | 5.0 | 2.5 | 2.5 | 5.0 | 5.0 |
| Sodium hydroxide | 1.3 | 1.3 | 1.3 | 0.7 | 1.4 | 0.7 | 1.4 |
| Sodium carbonate | 1.2 | 1.2 | 1.2 | 1.0 | | 1.2 | |
| Sodium silicate | — | — | — | — | — | 0.2 | — |
| Sodium metaborate | 1.0 | — | 0.75 | 1.0 | 0.75 | 0.5 | — |
| Sodium tetraborate | — | 1.2 | 1.0 | — | — | — | 0.5 |
| Tinopal PLC ® | — | 0.01 | — | — | — | 0.1 | — |
| Tert-butyl alcohol | 0.05 | 0.1 | 0.5 | 0.3 | 1.0 | 0.1 | 0.2 |
| 2-methyl 2-butanol | 0.05 | — | 0.5 | 0.3 | 1.0 | 0.1 | 0.2 |
| 2-methyl 2-pentanol | 0.05 | 0.1 | — | 0.3 | 1.0 | 0.1 | 0.2 |
| Minors and water | | | balance up to 100% | | | | |

All Examples have a pH of at least 8.

Tinopal PLC® brightener is bis(sulfobenzofuranyl) biphenyl, commercially available from Ciba-Geigy.

Tert-butyl alcohol, 2-methyl 2-butanol and 2-methyl 2-pentanol are for example commercially available from Aldrich as reagent grade materials.

All the above bleaching compositions provide excellent fabric safety and/or excellent whiteness to fabrics when used to treat fabrics.

What is claimed is:

1. A composition comprising a hypohalite bleach, a borate or boric acid or mixture thereof, and a tertiary alcohol or a polyalcohol according to the formula:

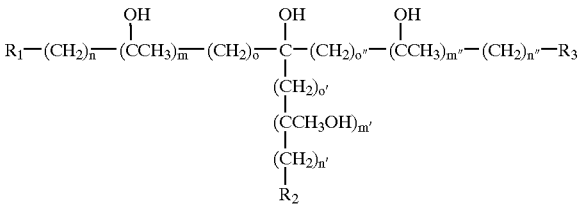

or a mixture thereof, wherein $R_1$, $R_2$, and $R_3$, are independently linear or branched, saturated or unsaturated hydrocarbon chains of from 1 to 30 carbon atoms optionally comprising one or more $C_5$ to $C_7$ aromatic or aliphatic ring structures; and m, m', m", n, n', n" o, o', and o" are independently integers of from 0 to 1000.

2. A composition according to claim 1 wherein said hypohalite bleach is an alkali metal or an alkaline earth metal hypochlorite.

3. A composition according to claim 1 comprising from 0.01% to 20% by weight of the total composition of said hypohalite bleach.

4. A composition according to claim 1 wherein said borate is an alkali metal salt of borate or an alkyl borate or a mixture thereof.

5. A composition according to claim 1 comprising from 0.01% to 10% by weight of the total composition of said borate or boric acid or a mixture thereof.

6. A composition according to claim 1 wherein said tertiary alcohol or polyalcohol comprises one or more $C_5$ to $C_7$ aromatic or aliphatic ring structures in $R_1$ and/or $R_2$ and/or $R_3$.

7. A composition comprising a hypohalite bleach, a borate or boric acid or mixture thereof, and a tertiary alcohol or a polyalcohol wherein said tertiary alcohol or a polyalcohol is selected from the group consisting of tert-butyl alcohol, tert-amyl alcohol, 2-methyl 2-butanol, 2-methyl 2-pentanol, 2,4-dimethyl butane-2,4-diol or a mixture thereof.

8. A composition according to claim 1 comprising from 0.001% to 20% by weight of the total composition of said tertiary alcohol or polyalcohol or a mixture.

9. A composition according to claim 1 wherein the molar ratio of borate or boric acid or a mixture thereof to tertiary alcohol or polyalcohol or a mixture is from 1:1 to 30:1.

10. A composition according to claim 1 wherein said composition has a pH of from 8 to 14.

11. A composition according to claim 1 which further comprises an alkalinity source.

12. A composition according to claim 11 wherein said alkalinity source is selected from the group consisting of sodium hydroxide, potassium hydroxide, lithium hydroxide and alkali metal oxides such as sodium or potassium oxide, and mixtures thereof.

13. A composition according to claim 12 comprising up to 10% by weight of the total composition of said alkalinity source.

14. A composition according to claim 1 which further comprises an optional ingredient selected from the group consisting of pH buffering components, surfactants, pigments, dyes, optical brighteners, solvents, stabilizing agents, enzymes, chelating agents, radical scavengers, builders, hydrotropes and mixtures thereof.

15. A composition according to claim 1 wherein said composition is liquid.

16. A composition according to claim 14 wherein said composition is solid.

17. A process of treating fabrics which comprises the step of contacting said fabrics with a composition according to claim 1 in its diluted form at a dilution level with water of up to 500:1 (water:composition).

18. A process according to claim 17 wherein said fabrics are washed with a detergent composition comprising at least one surface active agent before the step of contacting said fabrics with said composition and/or during the step where said fabrics are contacted with said composition and/or after a rinsing step after said composition has been removed.

19. A process of treating a fabric which comprises the steps of contacting said fabric with a composition according to claim 15, in its neat form, allowing said fabric to remain in contact with said composition for a period of time sufficient to treat said fabric, and then rinsing said fabric in water to remove said composition.

20. A process of treating a hard-surface with a composition according to claim 15, wherein said process comprises the step of applying said composition to said hard-surface in its neat or diluted form and optionally rinsing said hard-surface.

* * * * *